US005138742A

United States Patent [19]

Charky

[11] Patent Number: 5,138,742

[45] Date of Patent: Aug. 18, 1992

[54] POWER-ASSISTED ARM FOR MOBILE VACUUM TRASH COLLECTOR

[75] Inventor: Gabriel Charky, Montreal, Canada

[73] Assignee: C.B.C. Municipal Equipment Inc., Longueuil, Canada

[21] Appl. No.: 700,521

[22] Filed: May 15, 1991

Related U.S. Application Data

[60] Division of Ser. No. 437,159, Nov. 16, 1989, Pat. No. 5,058,235, which is a continuation-in-part of Ser. No. 92,718, Aug. 25, 1987, abandoned.

[30] Foreign Application Priority Data

Aug. 27, 1986 [CA] Canada ..... 516976

[51] Int. Cl.[5] ..... A47L 9/00

[52] U.S. Cl. ..... 15/340.1; 15/347; 15/352; 15/354

[58] Field of Search ..... 15/340.1, 347, 352, 15/354, 414

[56] References Cited

U.S. PATENT DOCUMENTS

| | | | |
|---|---|---|---|
| 2,652,902 | 9/1953 | Sheahan | 15/327.6 X |
| 2,663,894 | 12/1953 | Elliotte | 15/414 X |
| 2,878,508 | 3/1959 | Sedgwick et al. | 15/340.1 X |
| 3,052,908 | 9/1962 | Daneman | 15/340.1 X |
| 3,150,404 | 9/1964 | Johnson | 15/340.1 X |
| 3,343,199 | 9/1967 | Nolte | 15/352 X |
| 3,348,258 | 10/1967 | Daneman | 15/340.1 X |
| 3,406,424 | 10/1968 | Rush | 15/354 X |
| 3,451,495 | 6/1969 | Bayless et al. | 15/340.2 X |
| 3,506,998 | 4/1970 | Perry | 15/354 X |
| 3,903,565 | 9/1975 | Hicks | 15/340.1 X |
| 3,984,893 | 10/1976 | Ashley | 15/340.1 X |
| 4,010,015 | 3/1977 | Brown | 15/340.1 X |
| 4,019,219 | 4/1977 | Willenborg | 15/340.1 X |
| 4,095,398 | 6/1978 | Aumann et al. | 15/340.1 X |
| 4,310,998 | 1/1982 | Cuba | 15/340.1 X |
| 4,433,532 | 2/1984 | McCunn | 15/340.1 X |
| 4,535,501 | 8/1985 | Hollowell et al. | 15/340.1 X |
| 4,659,262 | 4/1987 | van Aalst | 15/340.1 X |

FOREIGN PATENT DOCUMENTS

| | | | |
|---|---|---|---|
| 203581 | 10/1983 | Fed. Rep. of Germany | 15/340.1 |
| 8004977 | 4/1982 | Netherlands | 15/340.1 |

*Primary Examiner*—Harvey C. Hornsby
*Assistant Examiner*—Stephen F. Gerrity
*Attorney, Agent, or Firm*—Sim & McBurney

[57] ABSTRACT

A mobile vacuum trash collector comprised of a motorized cart, a frame connected rearwardly of the cart, a bin mounted on the frame, a lid removably connected to the bin and a flexible hose connected to the lid at one end and having a nozzle at the other end. The hose is held via a rigid supporting arm above an operator's head and is maneuverable by the operator using a telescopic arm which interconnects an intermediate portion of the hose via the arm and the nozzle. A vacuum motor is mounted at the bottom of the bin for drawing airborne trash through the hose and downwardly into the bin. An air permeable bag is suspended in the bin for collecting the trash, the air bag being drawn downwardly and out of the bin via an exhaust port. Because suction is provided continuously downwardly through the bin, large quantities of debris are sucked into the bag and compressed or compacted. Furthermore, because the motor is mounted at the bottom of the bin, the entire apparatus has a low center of gravity and is very stable when moving over inclines and curbs.

9 Claims, 5 Drawing Sheets

POWER-ASSISTED ARM FOR MOBILE VACUUM TRASH COLLECTOR

CROSS REFERENCE TO RELATED APPLICATION

This is a divisional of application Ser. No. 437,159 filed Nov. 16, 1989 (now U.S. Pat. No. 5,058,235) which is a refile of application Ser. No. 260,388, filed Oct. 20, 1988 (abandoned), which is a continuation-in-part of application Ser. No. 092,718, filed Aug. 25, 1987 (abandoned).

FIELD OF THE INVENTION

This invention relates in general to trash collecting devices, and more particularly to a mobile vacuum trash collecting device useful for cleaning debris from roadways, sidewalks and parkland.

DESCRIPTION OF THE RELATED ART

In an effort to maintain a clean urban environment, various regional municipalities have employed personnel and equipment to collect trash, such as discarded bottles, cans, paper containers, etc., from their parks and streets.

One prior art device functions as a motorized sweeper for scattering debris from principal thoroughfares, such as sidewalks. The prior art device does not actually collect any trash, thereby requiring manual collection using picks, brooms and shovels, etc., and attendant manhour costs. Motorized sweepers also typically exhibit poor maneuverability for negotiating obstacles, and cannot be driven over grassy surfaces, such as found in parks.

In an effort to overcome the disadvantages associated with manual trash picking and motorized sweeping, another prior art device was developed to collect trash and debris by means of a mobile vacuum trash collector. This prior art device is described in Canadian Patent No. 949,707, issued Jun. 25, 1974 to Hollowell, and entitled "Vacuum Trash Collector".

The Hollowell device comprises a pivoted cylindrical bin mounted to a frame connected to a motorized cart, such as a conventional golf cart. A retractable lid for the bin is connected to the frame via a complex spring loaded arrangement, and is surmounted by a vacuum blower. A flexible hose is supported over an operator's head by a resilient leaf spring extending from the frame, and one end of the hose is connected tangentially to the lid while the other end is connected to the nozzle.

In operation, the vacuum blower of Hollowell draws airborne debris through the flexible hose, into the lid, and upwardly toward a rotating baffle. The lid is of frusto-conical shape and acts as a plenum chamber for swirling the airborne debris after its tangential introduction thereto via the hose. The air is drawn upwardly and out of the blower through an exhaust port.

A shaft of the vacuum blower extends vertically downward into the lid for driving the rotating baffle. The baffle deflects debris from being drawn upwardly into the blower, thereby preventing the vacuum blower from becoming choked or clogged. The baffle throws the larger debris centrifugally against the inside of the lid, maintaining the swirling action and grinding smaller debris into tiny particles which pass through the blower and are collected by a filter bag connected to the exhaust port.

Eventually, the heavier items of swirling debris settle downwardly into the bin as a result of gravitational force, and are collected in a large plastic bag, such as an industrial garbage bag.

As a result of the opposing forces of upwardly directed suction on the one hand, and downwardly directed gravity on the other, the Hollowell device suffers from the disadvantage that the trash is loosely collected in the bag. Accordingly, the operator is required to either frequently empty the bag, or periodically manually compress or compact the trash to allow additional trash to be collected.

More importantly, it has been found that certain articles such as plastic bags or large sheets of paper tend to cling to the rotating baffle due to the upward suction which, in response, typically chokes or clogs the vacuum blower. The operator is then required to stop the vehicle, open the lid, disentangle and then remove the plastic bag etc. before recommencing normal operation.

In fact, it has been discovered that the upward suction provided by the Hollowell device imposes a practical limit to the amount of vacuum pressure that his device is capable of delivering without clogging the baffle and blower, as discussed above. For instance, it has been found that the amount of vacuum pressure required to lift empty beer bottles, etc., using the Hollowell device, causes the lighter items already collected within the bin to be sucked upwardly, thereby entangling the baffle and choking the blower.

In addition, as a result of the vacuum blower being mounted on the lid, the center of gravity of the device is high, tending to make the cart unstable and liable to toppling over when travelling on an incline or over curbs. Also, the operator is subjected to continuous, loud, and conceivably deafening engine noise emanating from the vacuum blower mounted directly behind his or her head.

SUMMARY OF THE INVENTION

According to the present invention, a mobile vacuum trash collecting device is provided having a blower disposed in the bottom of the bin, for drawing airborne debris through the flexible hose and the length of the bin. An air permeable bag is suspended in the bin for collecting the debris while the air is sucked therethrough for discharge via an exhaust port. The air permeable bag can be made for instance from jute, fibrous plastic, or other suitable porous material such as fibrous polypropylene.

Because the vacuum blower is located at the bottom of the bin, as opposed to being mounted on the lid as in Hollowell, the air and airborne debris are sucked downward toward the bottom of the bin. The air permeable bag provides a large filtration surface such that large quantities of debris are sucked into the bag and compressed or compacted as a result of the continuous downward force. Hence, a great deal of trash can be collected within a single bag without requiring intermittent manual compaction, as in the Hollowell device.

The device of the present invention is characterized by a low center of gravity, making the cart more stable, and less likely to topple over than the Hollowell device. In addition, the operator using the device of the present invention is not exposed to ear-level vacuum blower noise.

Furthermore, the lid according to the present invention may be easily lifted to allow the bin to be tilted to an emptying position, in contrast with the Hollowell device which utilizes a complex arrangement of pivot, counterbalancing spring, and bracket to urge the heavy and cumbersome lid with blower upwardly for tilting the bin.

Most importantly, as a result of creating a continuous downward force of suction, the device embodying the present invention is capable of generating much greater vacuum pressure than Hollowell, without clogging the blower. Thus, the device of the present invention can be utilized to collect heavy objects such as beer bottles, etc. Also, flimsy articles such as plastic bags. etc., may be collected without the risk of choking the blower since the articles are sucked downwardly, directly into the air permeable bag which as discussed above, provides a larger filtration surface than the baffle in the Hollowell device.

BRIEF DESCRIPTION OF THE DRAWINGS

These and other advantages of the invention will be better understood with reference to the detailed description below in conjunction with the following drawings, in which.

DESCRIPTION OF THE PREFERRED EMBODIMENTS

Figure 1:
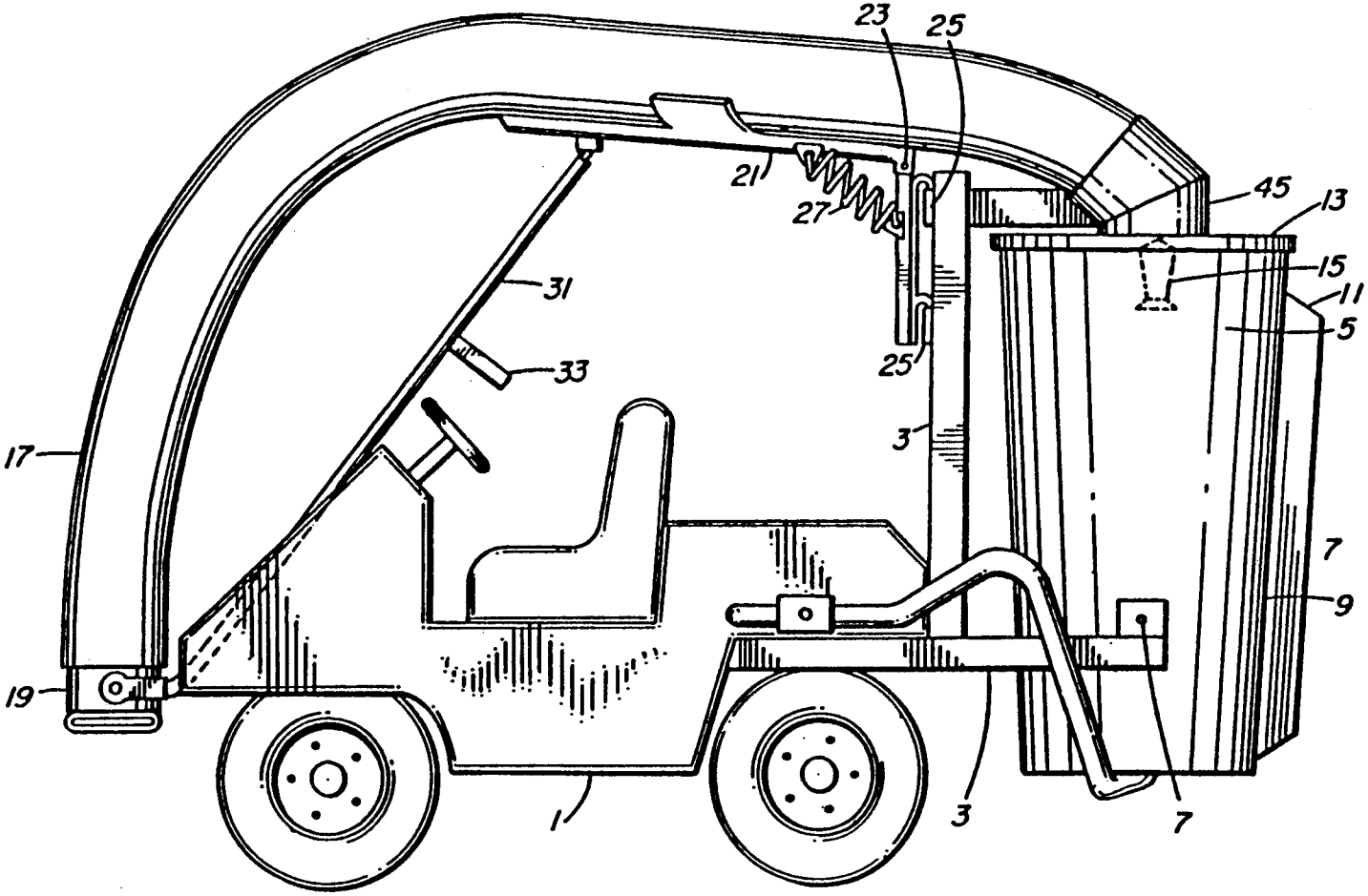
FIG. 1 is a side elevation view of a mobile vacuum trash collecting device in accordance with the present invention.

With reference to FIG. 1, a mobile vacuum trash collecting device is illustrated comprising motorized cart 1, such as a small gas powered tractor, or other vehicle, such as the golf cart of Hollowell. A metal frame 3 is bolted securely to the cart 1, and a trash collecting bin 5 is pivotally mounted at 7 to the frame 3. An exhaust stack 9 directs air from the bottom of the bin to an outlet 11.

A lid 13 is removably mounted to the top of the bin 5 via a pair of clips 15 disposed on either side of the bin. A flexible hose 17 extends vertically from the center of the lid 13, forming an arc over the operator's head and having a nozzle 19 proximate the ground at a remote end thereof. The hose 17 is supported over the operator's head by a rigid support arm 21 pivoted to the frame 3 at 23 for vertical movement, and at 25 for sideways movement. The arm 21 is resiliently supported from the frame 3 by a coiled spring 27 which is preferably adjustable to raise or lower the vertical equilibrium position of the hose.

A telescoping arm 31 connects an intermediate portion of the hose 17 via the support arm 21 to the nozzle 19, and a handle 33 is disposed thereon for allowing the operator to maneuver the nozzle to various positions along the ground and around the cart 1.

In operation, the cart 1 is driven by an operator who maneuvers the nozzle 19 via the handle 33 and telescoping arm 31 to pick up debris such as discarded paper, bottles, cans, etc., from sidewalks, lawns, roads, and parks, etc. As discussed above the low center of gravity allows the cart 1 to be driven along inclines such as hills or over curbs, without substantial risk of toppling over.

Once the internal air permeable bag (see FIG. 2) is full, the cart 1 is stopped and the operator disengages clips 15, allowing the lid 13 (with hose 17 attached) to be easily lifted. The bin 5 is then tilted to a trash emptying position for emptying the bag.

A filter, such as a vacuum cleaner bag, may optionally be connected across the outlet 11, for collecting airborne dust and other particulate matter not entrapped within the bin 5, in order to prevent dust clouds from spewing out of the exhaust outlet 11.

Figure 2:
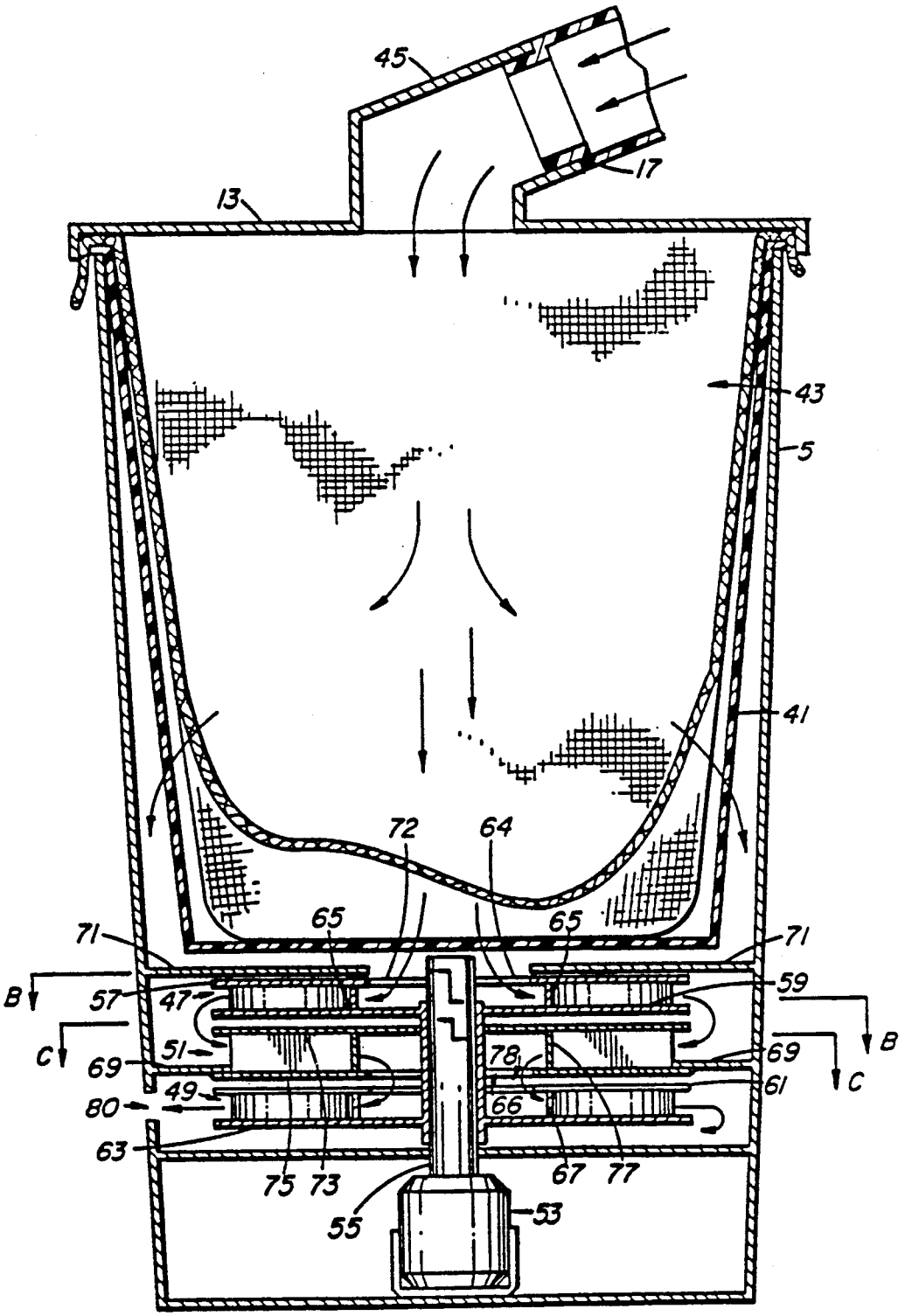
FIG. 2 is a cross sectional view of the bin taken along the line A—A of FIG. 1, including a vacuum blower mounted at the bottom thereof.

Referring to FIG. 2, the inside of bin 5 is shown in greater detail comprising a perforated holder 41, fabricated from grid iron etc., for supporting an air permeable bag 43 within the bin. A sleeve 45 extends from the lid 13 and is adapted to fit over the end of the hose 17. A vacuum blower is disposed at the bottom of the bin and is comprised of a pair of rotating fans 47 and 49, and a stationary air guide 51, all disposed in stacking arrangement over a motor 53, and surrounding a central rotating axle or shaft 55.

Motor 53 can be hydraulically or electrically operated (or other), causing rotation of the shaft 55 and fans 47 and 49 connected thereto, resulting in suction or negative pressure within the bin 5, for drawing trash therein through the hose 17.

Figure 3:
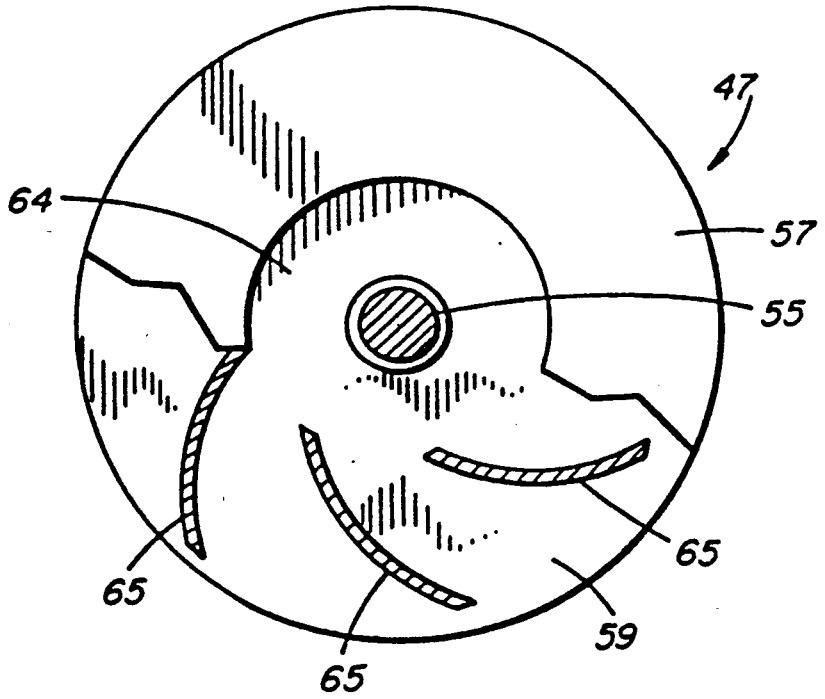
FIG. 3 is a partial cross sectional view of a centrifugal fan used in the vacuum blower, taken along the line B—B of FIG. 2.

With reference to FIGS. 2 and 3, the fans 47 and 49 are shown as preferably being centrifugal fans, each comprised of top and bottom circular discs (57,59 and 61,63) and a plurality of curved fins (65 and 67), sandwiched by the discs and forming a nautilus pattern when viewed from above. The topmost disc (57 and 61) of each fan has a centrally disposed circular aperture (64 and 66) therein for drawing air from the bin 5 into the fans.

As the fans 47 and 49 rotate, air is drawn centrifugally outward by the rotation of the fins 65 and 67, from center to the periphery thereof. Air drawn to the periphery of the upper fan 47 is received and rammed to the center of the stationary air guide 51, as discussed in greater detail below with reference to FIG. 4.

Annular seals or washers 69 and 71 ensure that air drawn into the vacuum blower does not escape therefrom, other than through the exhaust outlet. The seal 71 is located above the upper fan 47 and has a centrally disposed aperture 72 therein, through which the air passes from the bin to the inlet aperture 64 of upper fan 47.

Figure 4:
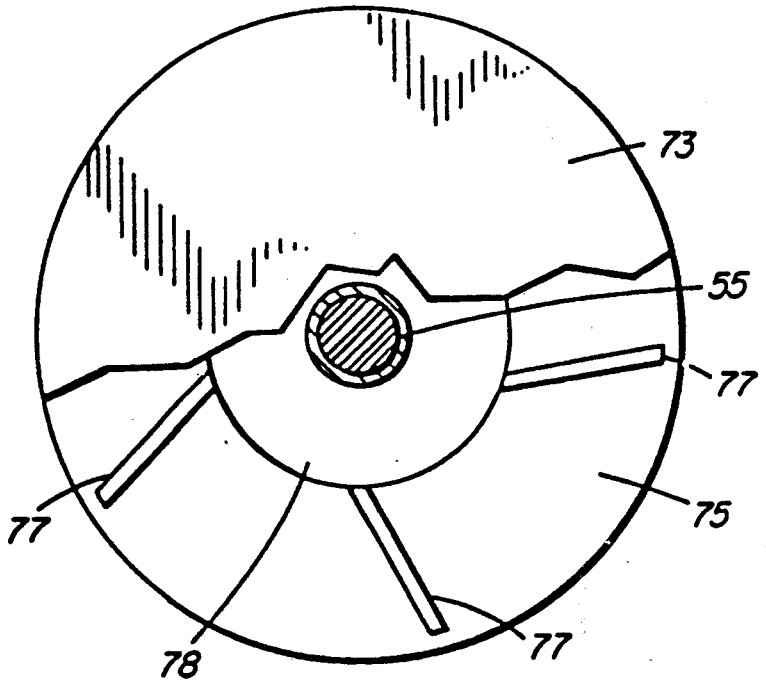
FIG. 4 is a partial cross sectional view of a stationary air guide used in the vacuum blower, taken along the line C—C of FIG. 2.

With reference to FIGS. 2 and 4, air guide 51 is illustrated comprised of top and bottom circular discs 73 and 75 and straight fins 77 for directing the outwardly drawn air at the periphery of fan 47 toward the center of the air guide. The bottom disc 75 has a centrally disposed circular aperture 78, similar to the aforementioned apertures 72, 64 and 66, for directing the airflow at the center of the airguide toward the aperture 66 to be received by the lower fan 49.

Fan 49 increases the static pressure through the bin 5 and draws the air from the central aperture 66 to the periphery, as discussed above with reference to fan 47.

The air forced out of fan 49 passes through an outlet 80 at the bottom of the bin and into the exhaust stack 9, FIG. 1.

In summary, the straight through suction implemented according to the present invention results in a high degree of compaction of trash as well highly efficient performance. The air permeable bag 43 traps and filters debris drawn into the bin such that the vacuum blower does not become blocked or clogged in the event high suction power is used, for collecting bottles, etc. As a matter of fact, as greater suction is applied according to the present device, greater compaction and efficient performance are obtained. As discussed above, a further important feature of the present invention is a high degree of vehicle stability coupled with less ear level noise than prior art devices. A person understanding the present invention may conceive of other embodiments or variations therein.

For example, the lid 13 can be permanently attached to the bin 5, and a door or other opening can be provided in the side of the bin for trash removal.

Also, while the device of the present invention has been described in terms of the bin 5 and frame 3 being mounted directly on the cart 1, an alternative would be to mount the frame on a pair of wheels and pull the frame behind the cart via a ball and socket hitch. In this way, the frame could be disconnected in order to use the cart on its own for other functions.

As a further alternative, the lid may be rigidly connected to the frame, and the bin can be connected thereto via a pair of slotted pivots. Upon releasing the clips 15, the bin 5 would drop in the slotted pivots under the force of gravity, to a position downwardly and away from stationary lid 13, for tilting to the trash emptying position.

As an alternative to resiliently supporting the arm 21 from the frame 3 by means of coiled spring 27 (FIG. 1), power assisted apparatus may be provided for maneuvering the support arm 21.

It has been found that manual maneuvering of the support arm 21 by means of telescoping arm 31 and handle 33 can result in unnecessary muscle strain for the operator of a mobile vacuum trash collector. In particular, it has been found that the force of suction at the hose inlet 19 can result in the inlet becoming stuck to the ground requiring substantial physical force by the operator to unstick the hose inlet 19 from the ground, sidewalk, road, etc.

According to the preferred embodiment, mobile cart 1 is provided with a three position switch 30 mounted on the handle 33. An electrical cord 32 extends in spiral fashion around telescoping arm 31 from the switch 30 along supporting arm 21 to a solenoid 34 supported on the frame 3. The electrical cord is secured to the support arm 21 and frame 3 by means of resilient metallic clips, etc. The solenoid valve 34 receives high pressure hydraulic fluid (e.g. oil) from a hydraulic pump 36 connected to a drive shaft (not shown) or other rotating component of the mobile cart 1.

For example, according to the preferred embodiment, the mobile cart 1 is a hydrostatic vehicle including a gasoline engine turning a drive shaft connected to a pair of in-line pumps, the first being a hydrostatic pump for providing traction to the vehicle wheels, and the second being hydraulic pump 36 for pumping oil at approximately 1500 pounds per square inch through hoses **28*a* and 28*b* via solenoid valve 34. The oil flows through hoses 28*a* and 28*b* in one of two directions for either extending or retracting a piston incorporated within hydraulic cylinder 27*a*, for raising or lowering the support arm 21**.

Figure 6:
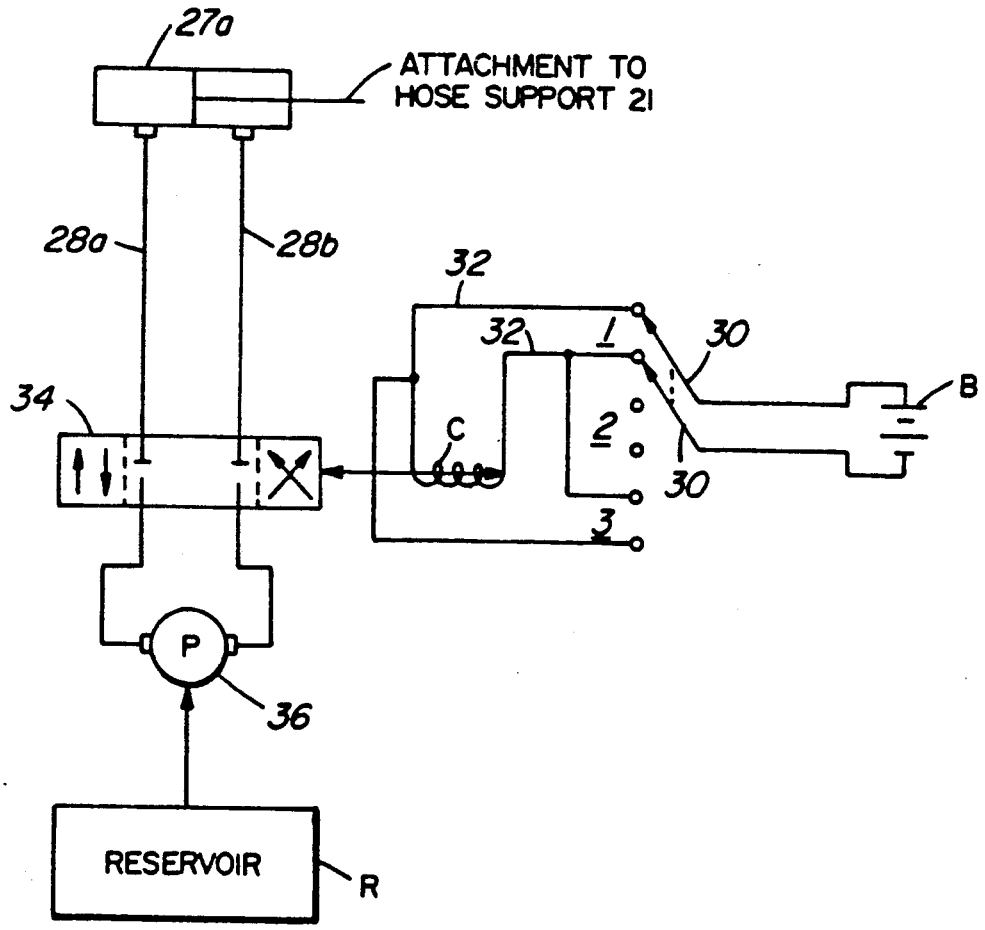
FIG. 6 illustrates an embodiment of the hydraulic power assisted support arm maneuvering system in schematic format.

FIG. 6 illustrates the hydraulic power assisted support arm maneuvering system in schematic format.

Figure 5:
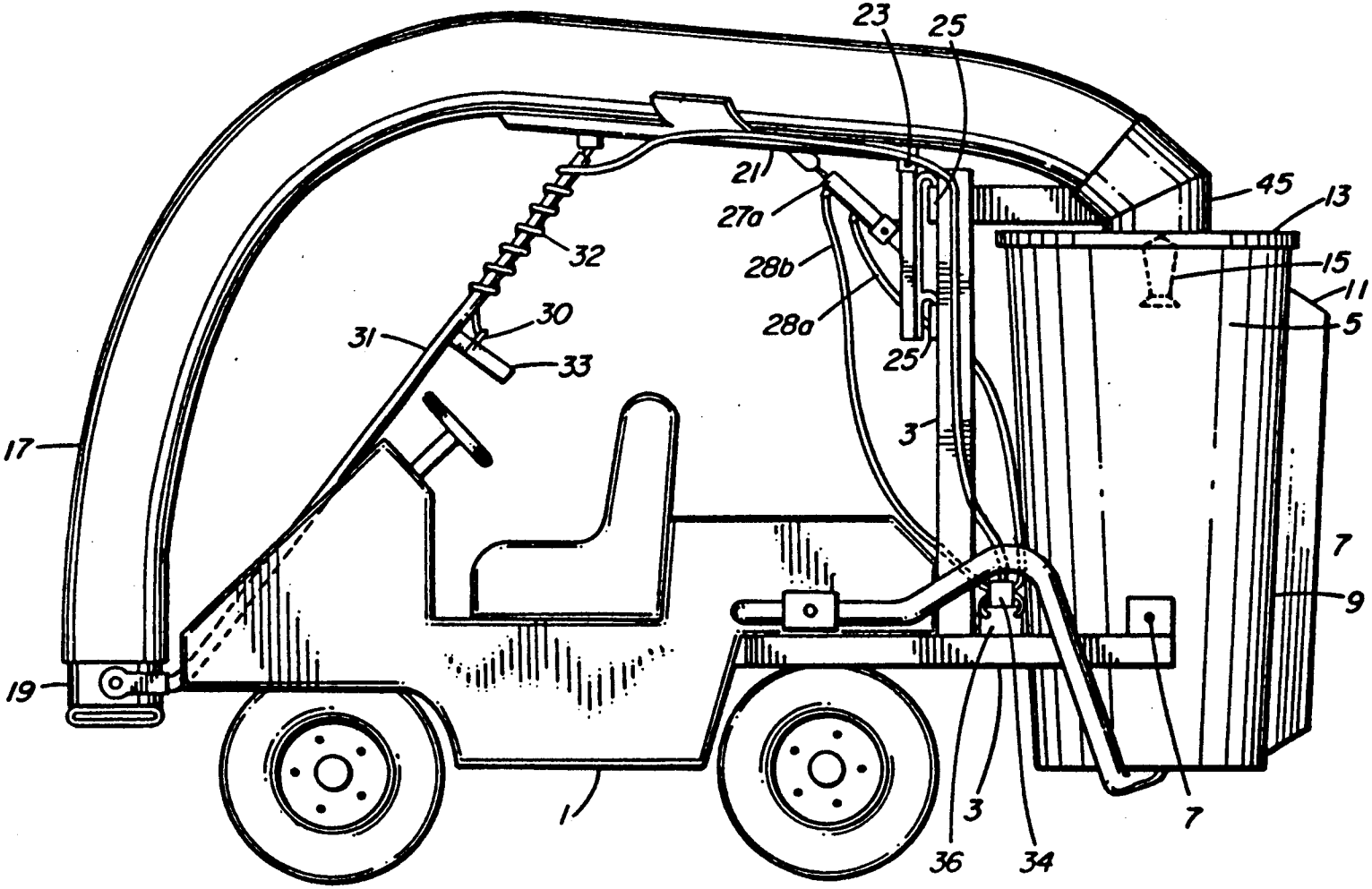
FIG. 5 is a side elevation view of an alternative embodiment of a mobile vacuum trash collecting device in accordance with the present invention.

In operation, with reference to FIGS. 5 and 6, in order to lift the support arm 21, and thereby also hose 17 and inlet 19, the operator pushes the switch 30 on handle 33 to a first position for causing current to flow through energizing coil C in a first direction. The switch 33 is preferably a double pole triple throw switch for connecting a battery B to one of either a first pair of terminals for causing current to flow in the aforementioned first direction, a second pair of terminals connected to an open circuit, or a third pair of terminals for causing current to flow through the coil C in a direction opposite to the first direction.

In response to current flowing through the coil C in the first direction, solenoid valve 34 is pulled to the right in FIG. 6 such that oil flows into the cylinder **27*a* through hose 28*a* and out of the cylinder through hose 28*b* for pushing the piston out relative to the cylinder 27*a*, thereby raising the support arm 21**.

Alternatively, in response to current flowing in the aforementioned second direction through coil C, the solenoid valve 34 is pushed to the left for causing fluid to flow from pump 36 into the hydraulic cylinder **27*a* via hose 28*b*, and out of cylinder 27*a* via hose 28*a*, thereby pulling the piston into the hydraulic cylinder 27*a* for lowering the support arm 21**.

The oil pumped via hydraulic pump 36, as well as the hydrostatic traction pump (not shown) is received from an oil reservoir R, in a well known manner.

The hydraulic pump 36 can also be used to drive a vacuum blower disposed within the bin 5 for drawing debris into the inlet 19 through hose 17 and therefrom into the bin.

In summary, an operator of the improved mobile vacuum trash collector of the present invention is able to maneuver the hose 17 and inlet 19 laterally by swinging the telescoping arm 31 to the left or right relative to the operator. The hose may be raised or lowered by simply pushing the three-position switch 30 to one of either the forward or reverse positions. The switch 30 is normally spring-biased to a centre position in which no current flows through the coil C and the solenoid valve 34 returns to a centre position (as shown in FIG. 6) such that no oil flows through the hoses **28*a* and 28*b*, thereby maintaining the position of the hydraulic cylinder and the support arm 21** at a predetermined orientation.

A person understanding the present invention as defined by the supplementary disclosure may conceive of other embodiments or variations therein. All such embodiments or variations are believed to be within the sphere and scope of the claims supported by the supplementary disclosure appended hereto.

I claim:

1. In a mobile vacuum trash collector comprised of a mobile cart for carrying a human operator, a bin secured to said cart, a hose connected at one end to said bin and having an inlet at the other end thereof, support means connected to said cart for holding said hose above said cart, and vacuum means connected to said cart for drawing debris via suction into said inlet, through said hose and therefrom into said bin; the improvement comprising power-assisted means connected to said support means for vertically maneuvering said support means, and thereby also said hose, and operator controlled means connected to said power-assisted means for generating and transmitting command signals to said power-assisted means for controlling operator thereof, further comprising a telescoping arm extending between said support means over said operator's head and said inlet, said telescoping arm including a handle to be gripped by said operator for allowing manual lateral movement of said support means, and said operator controlled means being mounted on said handle for allowing power assisted vertical movement of said support means.

2. A mobile vacuum trash collector as defined in claim 1, wherein said power-assisted means is comprised of supply and return hoses for conveying hydraulic fluid, a hydraulic pump connected to said supply and return hoses for pumping hydraulic fluid at a predetermined pressure therethrough, a solenoid valve, connected to said supply and return hoses for receiving said command signals and in response controlling the direction of flow of said fluid through said supply and return hoses, and a hydraulic cylinder housing a piston, and connected to said cart and said support means for receiving said fluid at said predetermined pressure and either pushing said piston out relative to said cylinder responsive to a first direction of flow of said fluid such that said support means is raised, or pulling said piston in relative to said cylinder responsive to a second direction of flow of said fluid opposite said first direction of flow such that said support means is lowered.

3. A mobile vacuum trash collector as defined in claim 2, wherein said operator controlled means is comprised of a switch having multiple positions for generating a first command signal in response to being positioned at a first one of said positions and generating a second command signal in response to being positioned at a second one of said positions wherein said solenoid valve directs said fluid in said first direction of flow responsive to receiving said first command signal whereby said support means is raised, and wherein said solenoid valve directs said fluid in said second direction of flow responsive to receiving said second command signal whereby said support means is lowered.

4. A mobile vacuum trash collector as defined in claim 2, wherein said solenoid valve is comprised of a plurality of movable ports connected to said supply and return hoses and disposed in predetermined positions for directing said flow of fluid in one of two directions through said hoses, and electro-mechanical means for receiving said first and second command signals and in response moving said ports to said predetermined positions, whereby said fluid flows into said hydraulic cylinder in said one of two directions for either pushing said piston out relative to said cylinder or pulling said piston in relative to said cylinder.

5. In a vehicular vacuum trash collector comprising a mobile cart for carrying a human operator through confined areas and around obstacles, means for maneuvering said cart under control of said human operator, a bin secured to said cart, a hose connected at one end to said bin and having an inlet at the other end thereof, support means connected to said cart for holding said hose above said cart, a handle means connected to said support means and located so as to be adjacent said human operator for allowing manual lateral maneuvering of said support means, and vacuum means connected to said cart for drawing debris via suction into said inlet, through said hose and therefrom into said bin; the improvement comprising power assisted means connected to said support means for vertically maneuvering said support means in conjunction with said lateral maneuvering, and operator controlled means connected to said power-assisted means for generating and transmitting command signals to said power-assisted means for controlling operation thereof, whereby maneuvering of said cart, lateral maneuvering of said support means and power-assisted maneuvering of said support means may be effected simultaneously by said human operator.

6. A mobile vacuum trash collector as defined in claim 5, wherein said power-assisted means is comprised of supply and return hoses for conveying hydraulic fluid, a hydraulic pump connected to said supply and return hoses for pumping hydraulic fluid at a predetermined pressure therethrough, a solenoid valve connected to said supply and return hoses for receiving said command signals and in response controlling the direction of flow of said fluid through said supply and return hoses, and a hydraulic cylinder housing a piston, and connected to said cart and said support means for receiving said fluid at said predetermined pressure and either pushing said piston out relative to said cylinder responsive to a first direction of flow of said fluid such that said support means is raised, or pulling said piston in relative to said cylinder responsive to a second direction of flow of said fluid opposite said first direction of flow such that said support means is lowered.

7. A mobile vacuum trash collector as defined in claim 6, wherein said operator controlled means is comprised of a switch having multiple positions for generating a first command signal in response to being positioned at a first one of said positions and generating a second command signal in response to being positioned at a second one of said positions wherein said solenoid valve directs said fluid in said first direction of flow responsive to receiving said first command signal whereby said support means is raised, and wherein said solenoid valve directs said fluid in said second direction of flow responsive to receiving said second command signal whereby said support means is lowered.

8. A mobile vacuum trash collector as defined in claim 6, wherein said solenoid valve is comprised of a plurality of movable ports connected to said supply and return hoses and disposed in predetermined positions for directing said flow of fluid in one of two directions through said hoses, and electro-mechanical means for receiving said first and second command signals and in response moving said ports to said predetermined positions, whereby said fluid flows into said hydraulic cylinder in said one of two directions for either pushing said piston out relative to said cylinder or pulling said piston in relative to said cylinder.

9. A mobile vacuum trash collector as defined in claim 5, further comprised of a telescoping arm extending between said support means over said operator's head and said inlet, said telescoping arm including said handle means to be gripped by said operator for allowing said manual lateral movement of said support means, and said operator controlled means being mounted on said handle means for allowing said power assisted vertical movement of said support means.

* * * * *